United States Patent [19]

Boehm et al.

[11] 4,411,392

[45] Oct. 25, 1983

[54] SPEED-COMPENSATING DEVICE FOR THE FEEDING OF THREADS TO A WEAVING OR KNITTING MACHINE

[75] Inventors: Alfred Boehm; Eberhard Richter, both of Naila, Fed. Rep. of Germany

[73] Assignee: LIBA Maschinenfabrik GmbH, Naila, Fed. Rep. of Germany

[21] Appl. No.: 243,351

[22] Filed: Mar. 13, 1981

[30] Foreign Application Priority Data

Apr. 3, 1980 [DE] Fed. Rep. of Germany ..... 3013203

[51] Int. Cl.[3] ..... B65H 54/20; B65H 59/38

[52] U.S. Cl. ..... 242/35.5 R; 66/84 A; 139/103; 242/45

[58] Field of Search ..... 242/45, 35.5 R, 75.5, 242/75.51, 75.52, 54 R, 131, 131.1; 66/84 A; 139/100, 101, 102, 103, 104, 105; 28/190, 193, 194, 200; 254/272, 273, 299, 300, 317, 318

[56] References Cited

U.S. PATENT DOCUMENTS

| | | | |
|---|---|---|---|
| 2,104,656 | 1/1938 | Krejci | 242/45 |
| 2,314,070 | 3/1943 | Bogoslowsky | 242/45 X |
| 2,331,662 | 10/1943 | Delano | 242/45 |
| 2,603,428 | 7/1952 | Newcombe | 242/45 |
| 2,961,216 | 11/1960 | Blair | 242/45 X |
| 3,049,308 | 8/1962 | Lang | 242/45 |
| 3,137,452 | 2/1964 | Winders | 242/45 X |
| 3,476,330 | 11/1969 | Curtland | 242/45 |
| 4,164,963 | 8/1979 | Black | 139/103 X |

FOREIGN PATENT DOCUMENTS

| | | | |
|---|---|---|---|
| 20462 | 7/1970 | Japan | 242/45 |

*Primary Examiner*—Stanley N. Gilreath
*Attorney, Agent, or Firm*—Anthony A. O'Brien

[57] ABSTRACT

Clutches in rotating drives of spools feeding threads to a weaving or knitting machine are disengaged when respective gravity-biased travelling compensating pulleys reach their lower limits and are reengaged when the respective pulleys reach their upper limits. The variable loops of thread formed by the compensating pulleys compensate for different speeds of thread take up by the machine.

4 Claims, 3 Drawing Figures

SPEED-COMPENSATING DEVICE FOR THE FEEDING OF THREADS TO A WEAVING OR KNITTING MACHINE

BACKGROUND OF THE INVENTION

1. Field of the Invention

The invention relates to a speed-compensating apparatus for feeding a plurality of threads to a weaving or knitting machine in which threads are taken up at different speeds, the threads being withdrawn tangentially from spools which are provided with a drive.

2. Description of the Prior Art

Normally the threads fed to such machines are drawn off endwise from the spools, that is, each thread is drawn over a free end of each spool which is not rotated. However in this action the thread is twisted, since in withdrawal over 360°, it is twisted once about its axis. In some machines this twisting is undesired, and the threads must be withdrawn tangentially from the spools, which requires that the spools rotate. If the threads are taken up at different speeds by the machine, either the spools must be driven with correspondingly different speeds, which would necessitate an expensive drive system, or a special speed-adjusting device must be provided.

SUMMARY OF THE INVENTION

The problem of adjusting the thread feeding speed in a weaving or knitting machine is solved in accordance with the invention by passing each thread around the underside of a free travelling compensating pulley which is biased downward by its weight and is movable downward and upward over a specific range of travel. Before each compensating pulley reaches the lower end of its range of travel during downward movement, a first control device produces a signal which indicates the presence at the lower position of the corresponding compensating pulley. In response to the signal from the first control device, the corresponding spool drive clutch is disengaged so that the compensating pulley rises due to continued withdrawal of the thread by the machine. Before each compensating pulley reaches the upper end of the range of travel during upward movement, a second control device produces a signal indicating the presence of the compensating pulley at this point to engage the corresponding spool drive.

The travelling compensating pulley, provided for each thread and movable upwards and downwards over a specific range of travel, produces a thread reservoir which, within the limits of its range of travel, can take up additional thread when the drive speed for the spool exceeds the take-up speed of the machine or can deliver additional thread when the take-up speed of the machine exceeds the drive speed for the spool. When a spool drive clutch is alternately engaged and disengaged in response to the corresponding first and second control devices, the compensating pulley alternately moves downwards and upwards; the speed of movement in each direction varies in accordance with differing thread withdrawal speed of the machine.

The above-explained speed-compensating device finds preferred utilization in warp knitting machines to which transversely extending weft threads are fed in order, for example, to reduce the possibility of transverse stretching of the knitted fabric. These weft threads are laid by a weft carriage moving to and fro over the width of the machine. The weft threads are fed to the weft carriage from above approximately in the middle of the machine width, so that even in the case of substantially constant speed of the weft carriage (apart from the reversing and acceleration at the ends of its travel) a varying thread withdrawal speed results. The thread withdrawal speed here varies periodically from a value close to zero up to a maximum speed.

The second control device can advantageously be formed by a timer actuated by the first control device which is formed by a detector. The duration of the timer is set so that, taking in consideration the mean speed of withdrawal of the working machine, the timer produces a signal; thus the upper end of the range of travel is reached, by the timer in accordance with the mean speed of thread withdrawal.

The capacity of the thread reservoir can be increased by forming the compensating pulley as a multiple pulley around which the thread is passed more than once in a manner similar to the passing of a rope more than once around a multiple pulley tackle block.

For guiding the compensating pulleys, two rails are expediently provided for each pulley which is guided between rails and rests on the rails, the rails being slightly inclined in relation to the vertical in such a way that the weight of the compensating pulleys just presses them against the rails. In this arrangement, practically only the force of gravity acts upon the compensating pulleys during their upward and downward movement, without excessive friction being exerted by the rails upon the compensating pulleys. Consequently the compensating pulleys can adapt themselves immediately to quick variations of speed of withdrawal.

BRIEF DESCRIPTION OF THE DRAWINGS

An example of embodiment of the invention is illustrated in the figures, wherein.

DESCRIPTION OF THE PREFERRED EMBODIMENTS

Figures 1, 2, 3:
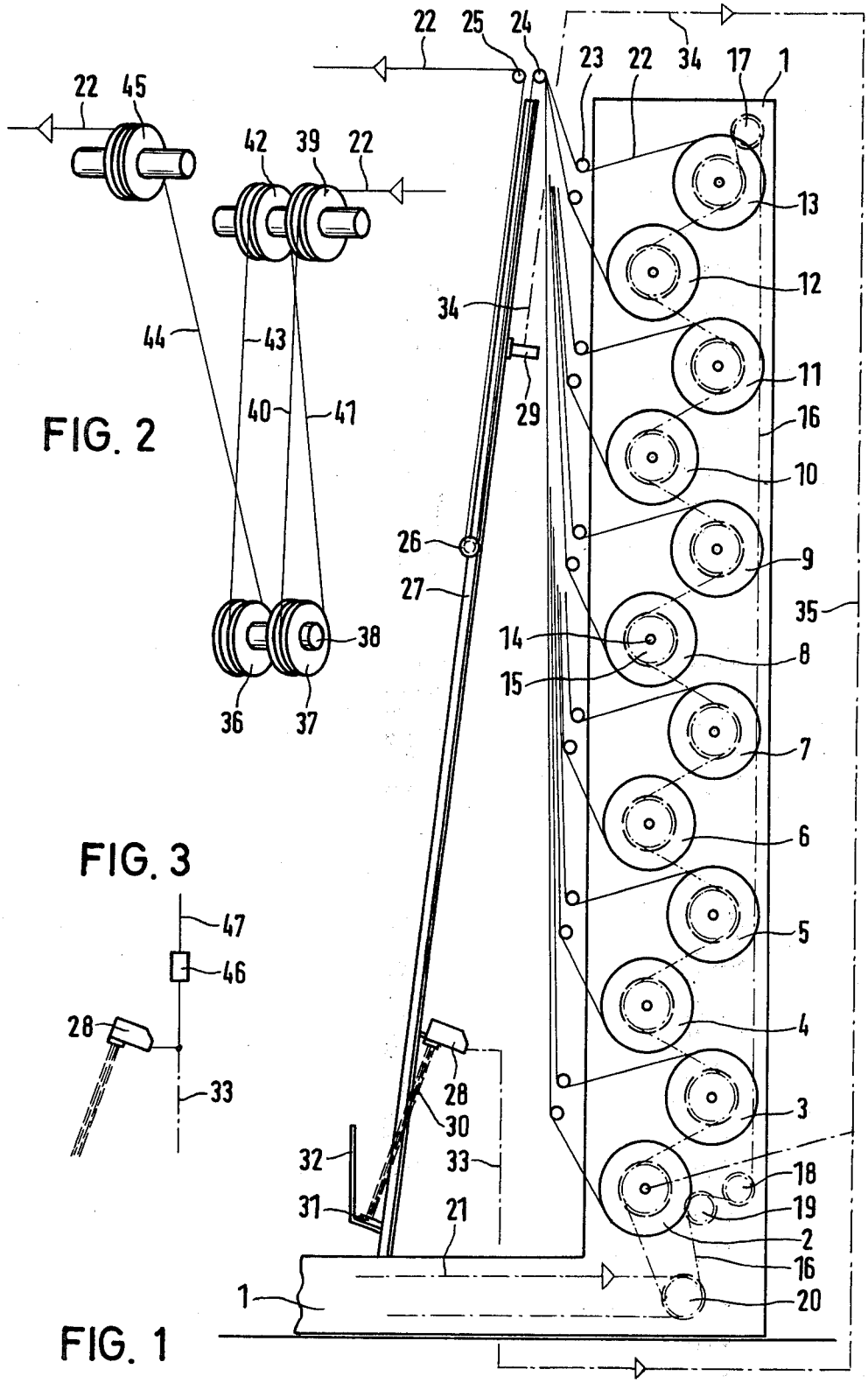
FIG. 1 is side-elevational diagrammatical illustration of an apparatus for feeding threads to a machine in accordance with the invention.
FIG. 2 is a perspective illustration of a double pulley variation for the apparatus of FIG. 1.
FIG. 3 is a diagram of a modified control arrangement for the apparatus of FIG. 1.

A thread feeding apparatus with speed-compensation as illustrated in FIG. 1 includes a frame 1 on which a plurality of spindles 14 (only one spindle identified by numeral 14 at spool 8) are rotatably mounted for supporting spools 2–13 pushed onto the respective spindles. A sprocket and clutch mechanism 15 is coupled to each spindle for driving the respective spools. An endless chain 16 is looped around all the clutch sprockets 15 as well as idler sprockets 17, 18 and 19 in a return path. The chain 16 is also looped around one sprocket of a double sprocket 20 which has its other sprocket coupled to a chain 21 driven by a drive system (not shown). Thus on rotation of this drive system when the clutch mechanisms 15 are driving the spindles 14, the spools 2–13 are rotated.

A set of pulleys 23, 24 and 25 is suitably arranged for directing a thread 22 tangentially from each of the spools 2–13 on which the threads 22 are wound. The threads 22 are then fed from the reversing pulleys 25 to the working machine (not shown).

As may be seen from FIG. 1 between the pulleys 24 and 25, each thread 22 is guided around a corresponding compensating pulley 26 which holds the thread 22 under tension by reason of its weight. Each compensating pulley 26 is guided between two rails (only the rear rail 27 is illustrated). The compensating pulley 26 constantly rests on the rails 27 by reason of a slight oblique placing of the rails 27 in relation to the vertical, the weight of the compensating pulley 26 holding the pulley 26 lightly against the rails 27. By reason of the only slightly oblique placing of the rails 27, there is insufficient friction between the compensating pulley 26 and the rails 27 to produce any practical noticeable effect. Thus practically, only the force of gravity is effective in moving the compensating pulley 26, apart from the tension of the thread 22. Consequently the compensating pulley 26 can adapt itself immediately to quickly varying speeds and tensions of the thread 22.

Each speed-compensating device as illustrated furthermore possesses a first control device 28 and a second control device 29. The first devices 28 are for example light detecting control systems in which a light beam 30 is emitted by each device and each device includes means for detecting reflected light. Mirrors 31 for reflecting the light beams 30 back to the devices 28 are arranged within guard plates 32 which also serve to catch the respective compensating pulleys 26 running down inthe case of breakage of the threads 22. Each first control device 28, when the compensating pulley 26 runs through its light beam 30, gives off a signal which through a signal lead represented in dot-and-dash line 33 is conducted to the corresponding clutch mechanism 15 of the spool concerned (illustrated in FIG. 1 only for the spool 2). Each clutch mechanism is such that the clutch mechanism is disengaged between its drive sprocket and spool in response to the signal from the corresponding first control device. Thus each thread 22 is withdrawn from its spool over pulleys 23 and 24 with a very low or zero speed when its clutch mechanism is operated by the signal on line 33 while thread 22 is drawn off over the pulley 25 by tension from the working machine at a speed greater than speed of the thread supplied over pulley 24. Consequently the compensating pulley 26 is pulled up on the rails 27. The control device 28 is positioned so that the light beam 30 is directed to cross the path of movement of the compensating pulley 26 over a relatively great length of its downward movement such that the compensating pulley 26 interrupts the light beam 30 during the entire time required for the first control device 28 to operate the clutch.

The compensating pulley 26 is pulled up in the drawing off of the thread 22 over the pulley 25 by the knitting or weaving machine, until the compensating pulley 26 comes into the region of the second control device 29. This second control device 29 is for example a conventional proximity switch in which an electric or magnetic field is disturbed by the movement of the compensating pulley 26 into proximity thereto so that the control device 29 produces a signal. This signal is fed through the signal lead 34 likewise to the clutch mechanism 15 between the drive sprocket and the spool. Consequently the compensating pulley 26 descends again along the rails 27, whereby the thread reservoir fills again until the compensating pulley 26 comes into the light beam 30 again, whereupon the operation as described above is repeated in response to operation of the first control device 28. It is noted that second control devices 29 are provided individually for all of the compensating pulleys 26 for the corresponding spools 2–13. The relevant signal leads 33 and 34 are assembled in symbolic representation into a bundle 35 of signal leads from the control devices 28 and 29 to the corresponding clutches for spools 2–13.

In this way the thread reservoir provided by the range of travel of each compensating pulley 26 between its first control device 28 and its second control device 29 is constantly filled and emptied again, the compensating pulley 26 running downards for filling and upwards again for emptying.

This style of reservoir filling and emptying has the advantage that no separate expense has to be incurred for the drive systems for the spools 2–13 as regards their speed in adaptation to the speed of thread withdrawal. If in fact it were intended to keep the reservoir constantly in a middle position, it would have to be ensured by means of a special expensive regulating system that the drive systems of the spools 2–13 constantly run exactly at the speed corresponding to the speed of withdrawal by the knitting or weaving machine. Since thread spools are always wound with varying diameters so that the velocity of thread withdrawal fluctuates from spool to spool for a single spool rotational speed, an individual regulated drive system would have to be provided for each spool. In the present device, fluctuation in the velocity of thread withdrawal during the running of the compensating pulley 26 from one extreme position to its other position are readily compensated for by the pulley 26 running upward or downward faster or slower. In addition, the tension of all threads 22 is kept constant in the present apparatus, since the tension is dependent substantially solely upon the weight of the individual compensating pulleys 26. Since these pulleys possess equal weights the tension of all the threads remain constant.

In FIG. 2 there is illustrated a compensating pulley formed as double pulley, consisting of the single pulleys 36 and 37. The two single pulleys 36 and 37 are mounted each freely rotatably on the spindle 38. The thread 22 is here looped around the individual pulleys 36 and 37 as in a tackle block, the following thread course resulting:

The thread 22 runs firstly over the pulley 39 as thead piece 40 to the single pulley 37, then as thread piece 41 to the reversing pulley 42, then as thread piece 43 to the single pulley 36 and finally from the latter as thread piece 44 to the pulley 45 and thence to the weaving or knitting machine.

In the thread reservoir as illustrated in FIG. 2 there is a double storage capacity compared with the individual looping of the compensating pulley 26 of FIG. 1. This can naturally be increased still further by the provision of further single pulleys and correspondingly reversing pulleys, as in a tackle block.

In FIG. 3 another variation of the two control devices is provided. The control device 28 is again illustrated and works in the same manner as described with reference to FIG. 1. The signal emitter 28 through its signal lead 33 not only conrols the clutch mechanism between the drive sprocket and the spool, but furthermore upon producing a signal, also actuates a timer 46 which after a delay produces a signal on its output lead 47. This signal on output 47 is used to cause engagement of the corresponding clutch in the same manner as the output signal of the second control device 29 of FIG. 1. The delay of the timer 46 is set according to the mean speed of withdrawal of the thread 22 by the weaving or knitting machine so that the compensating pulley 26 ascends to a point approaching the end of the range of travel (i.e., to approximately the level of the second control device 29 in FIG. 1). At this moment the timing member 46 produces its signal on its output 47, which then through the signal lead 34 acts in the manner as described with reference to FIG. 1 to engage the clutch of the corresponding spool, whereupon the compensating pulley 26 slides downwards again.

Since many variations, modifications and changes in detail may be made to the above described embodiments, it is intended that all matter described in the foregoing description and shown in the accompanying drawings be interpreted as illustrative and not in a limiting sense. What is claimed is:

1. An apparatus for feeding threads to a weaving or knitting machine in which the threads are taken up by the machine from spools at different speeds, the apparatus comprising a common drive system with a plurality of clutch means for drivingly coupling corresponding spools when engaged, a plurality of compensating pulleys, one for each thread, freely movably within a vertically extending range of travel and biased by gravity for forming variable loops of the threads, first means for directing the threads tangentially from the spools and downwardly to corresponding compensating pulleys, second means for directing the threads upwardly from the compensating pulleys and to the machine, a plurality of first control means, each for detecting the presence of the respective compensating pulley adjacent the lower end of its range of travel to disengage a corresponding clutch means, and a plurality of second control means, each detecting the presence of a respectively compensating pulley and for operating when the respective compensating pulley is adjacent the upper end of its range of travel to reengage the corresponding clutch means.

2. An apparatus as claimed in claim 1 wherein each of the second control means includes a timer actuated in response to the signal from the corresponding first control means and producing a signal after a delay for reengaging the corresponding clutch means, the delay of said timer being set in accordance with a mean speed of the take up of the corresponding thread by the machine such that clutch means is reengaged when the corresponding compensating pulley reaches a position adjacent the upper end of its range of travel.

3. An apparatus as claimed in claim 1 or 2 wherein the plurality of compensating pulleys include multiple pulleys around which the corresponding threads are guided in the manner of a multiple pulley tackle block.

4. An apparatus as claimed in claim 1 or 2 including a plurality of pairs of rails, each pair of rails being designed for guiding a corresponding compensating pulley therebetween and being slightly inclined in relation to the vertical in such a way that the weight of the compensating pulleys urge the pulleys against the rails.

* * * * *